US005185945A

United States Patent [19]

Nielsen et al.

[11] Patent Number: 5,185,945

[45] Date of Patent: Feb. 16, 1993

[54] UNIVERSAL PROTECTIVE SHIELD FOR THE FOOT

[75] Inventors: Peter A. Nielsen; Paul F. Henthorn, both of Ventura, Calif.

[73] Assignee: The United States of America as represented by the Secretary of the Navy, Washington, D.C.

[21] Appl. No.: 911,801

[22] Filed: Jul. 10, 1992

Related U.S. Application Data

[63] Continuation of Ser. No. 726,956, Jul. 8, 1991, abandoned.

[51] Int. Cl.[5] ..... A43C 13/14

[52] U.S. Cl. ..... 36/77 R; 36/101; 36/110

[58] Field of Search ..... 36/110, 101, 77 R; 128/83.5, 82, 83

[56] References Cited

U.S. PATENT DOCUMENTS

| | | | |
|---|---|---|---|
| 564,966 | 8/1896 | Brewer | 36/77 R |
| 1,836,624 | 12/1031 | Sothen | 36/136 |
| 1,866,006 | 7/1932 | Bergstrand | 36/77 R |
| 2,507,120 | 5/1950 | Shapiro | 36/101 |
| 3,263,679 | 8/1966 | Hass | 36/77 R |
| 3,410,007 | 11/1968 | Peterson | 36/77 R |
| 3,487,830 | 1/1970 | Pruett | 36/77 R |
| 3,773,041 | 11/1973 | Bogar, Jr. et al. | 128/83.5 |
| 3,916,538 | 11/1975 | Loseff | 128/83.5 |
| 4,061,138 | 12/1977 | Bernstein | 128/83.5 |
| 4,078,266 | 3/1978 | Brown | 128/83.5 |
| 4,177,583 | 12/1979 | Chapman | 36/77 R |
| 4,454,872 | 6/1984 | Brouhard | 128/83.5 |

FOREIGN PATENT DOCUMENTS

| | | | |
|---|---|---|---|
| 0078913 | 5/1983 | European Pat. Off. | 36/77 R |

*Primary Examiner*—Jimmy G. Foster
*Assistant Examiner*—Thomas P. Hilliard
*Attorney, Agent, or Firm*—Ron Billi; Melvin J. Sliwka

[57] ABSTRACT

A universal protective shield includes a central portion with three or more fingers integral with the central portion; openings located between adjacent fingers and above the sole of the foot covering to which the shield is attached, the openings permitting the fingers and the central portion to be adapted to conform to a foot covering: and screws for fastening the protective shield to a foot covering via bores located in the fingers. Flaps, attached to the fingers, diminish the size of the openings. The present invention may be adapted from a flat template or reformed to fit different shaped foot coverings.

3 Claims, 1 Drawing Sheet

UNIVERSAL PROTECTIVE SHIELD FOR THE FOOT

This is a continuation of copending application Ser. No. 07/726,956 filed on Jul. 8, 1991, now abandoned.

BACKGROUND OF THE INVENTION

This invention relates generally to an apparatus for protecting the toes and front portion of the foot from injury. More specifically, but without limitation, the present invention relates to an adjustable universal protective shield that may be adapted by the user or installer to fit any shoe, cast or other foot covering and that may be reused and/or refitted to any size or type of foot covering.

When the front portion of the foot is injured, a doctor sometimes applies a protective/healing device such as a cast or wrapping during the healing process. After a period of time, the initial cast or wrapping is removed and a second protective/healing device is applied, usually of a smaller size. The toes usually protrude from the front end of these casts and can easily be slammed into stationary objects especially when the patient must navigate a sea of obstacles with a large, heavy or awkward device "grafted" to his foot. To protect the toes and front portion of the foot during the healing process, various types of protective devices have been employed that encapsulate the front part of the foot and attach by various means to the healing cast, shoe or other covering. These devices are not readily adaptable to fit the wide variety of peculiarly shaped coverings applied by doctors and cannot be easily reshaped or easily reformed to adapt to the subsequent smaller coverings applied in the later stages of healing. In addition, a wide variety of sizes and shapes must be on-hand to fit the man possibilities of configurations that might be encountered.

SUMMARY OF THE INVENTION

Accordingly, the present invention seeks to provide a universal protective shield that, in a single size, may be adapted to virtually any covering that may be encountered; from a cast on a small child to a wooden, orthopedic shoe for an adult to a wrapping on a teenager. The invention may also be reused and re-adapted for repeated application.

It is therefore an object of the present invention to provide an apparatus for protecting the toes and/or front part of the foot from contacting objects.

It is another object of the present invention to provide an apparatus that may be initially adapted to fit any foot covering.

It is a further object of the present invention to provide an apparatus that may be reused and on reuse may be re-adapted to fit any foot covering.

It is another object of the present invention to provide an apparatus that is simple, inexpensive and strong.

It is still another object of the present invention to provide an apparatus that may be easily fabricated in template form and that may be easily stored or shipped.

BRIEF DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
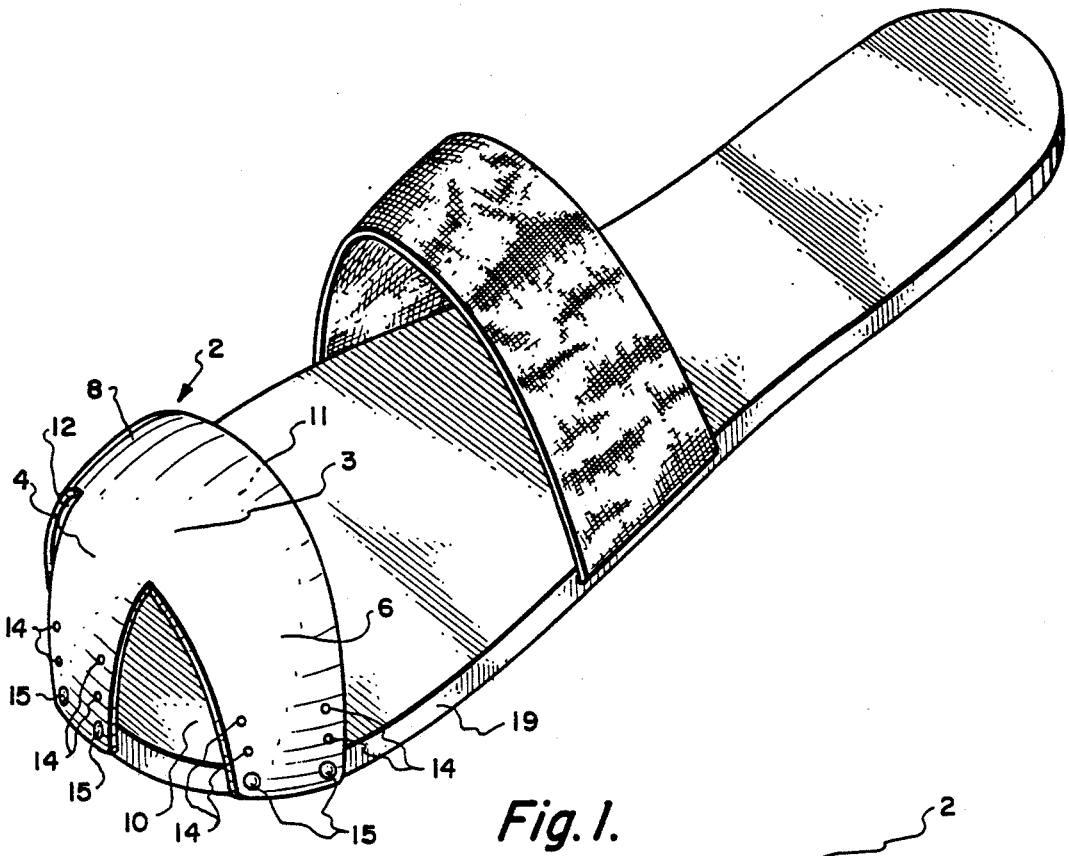
FIG. 1 is a perspective view of the present invention attached to an open-toed, wooden-soled post operation-shoe.
Figure 2:
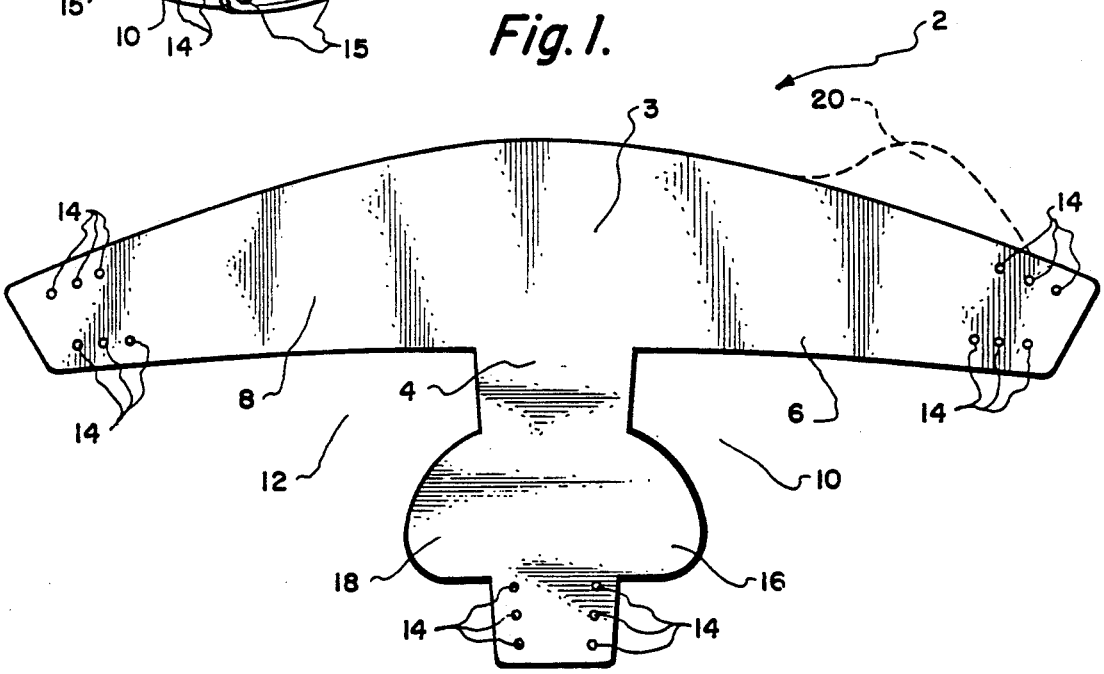
FIG. 2 is an illustration of a template of the present invention.

The preferred embodiment of the present invention is illustrated by way of example in FIGS. 1 and 2. As can be seen in FIG. 1, universal protective shield 2 includes mid portion 3, front finger 4, side finger 6 and side finger 8. The end portion of each finger includes bores 14 that may be used to secure universal protective shield 2 to a desired foot covering by inserting screws 15 through bores 14 and into the sole or other secure mounting point such as might be found on the foot covering. It should be noted that multiple holes 14 are provided in each finger so that universal protective shield 2 may be secured to both symmetric and non-symmetric shapes. In applications where no sole 19 or secure mounting location is available, a temporary or permanent adhesive may be placed between the inside surface of universal protective shield 2 and a foot covering.

When formed to adapt to a shoe sole, as shown in FIG. 1, shield 2 includes openings 10 and 12. Openings 10 and 12 allow, for example, the blood circulation in the toes to be checked and also provide for air circulation to the toe area. It should be noted that openings 10 and 12 permit universal protective shield 2 to be easily formed, as by bending, to adapt to any configuration desired. Accordingly, universal protective shield 2 may be bent to accommodate a range of configurations from wide to narrow; from pointed toe to blunt toe; from high to low; and to any odd configuration such as those found in foot casts. Universal protective shield 2 is thus truly universal in nature. The toes or front portion of the foot fit into the area designated as 11 in FIG. 1.

Universal protective shield 2 may be fabricated from a variety of materials, 5052-0 aluminum, 0.031" thick being preferred. Other materials such as non-corrosive plastic or steel may also be used.

FIG. 2 shows universal protective shield 2 in "template" form that is, cut out to the proper shape but not yet formed or adapted for a particular application. As can be seen, universal protective shield 2 includes flaps 16 and 18 located on either side of finger 4 which serve to diminish the size of openings 10 and 12 respectively. Thus, it can be seen that flaps 16 and 18 provide additional protection for the toes and front portion of the foot, when required. It should be note that similar flaps may be provided on either or both sides of fingers 6 and 8 (for example, see flap 20 in dashed lines). In addition, larger or other shaped flaps 16 and 18 may be provided in "template" form and later be easily trimmed to size, as required. Universal protective shield 2, may be easily cut, shipped and stored because of the flat, template shape.

Obviously many modifications and variations of the present invention are possible in light of the above teachings. It is therefore to be understood that within the scope of the appended claims, the invention may be practiced otherwise than as specifically described.

What is claimed is:

1. A universal protective shield consisting of a unitary piece of sheet material shaped and then fastened to a protective foot covering, the foot covering having a sole portion with a bottom for contacting the ground, comprising:

a) a central portion;

b) three or more fingers integral with the central portion, the fingers bendable by hand to communicate with a foot covering and then rebendable by hand to communicate with different foot coverings, the universal protective shield having openings between adjacent said fingers when said fingers are bent and communicating with said foot covering, the openings located above the sole portion of said foot covering, wherein one of the openings receives the toe portion of the foot and the other openings provide access to the toe portion of the foot, said fingers located above the bottom of said sole portion of said foot covering, said fingers further including one or more flaps for diminishing the size of said openings, the flaps located on said fingers;

c) means for fastening said universal protective shield to said foot covering.

2. The apparatus defined in claim 1, wherein said universal protective shield is aluminum.

3. The apparatus defined in claim 2, wherein the fastening means includes bores and screw means, the bores located in said fingers and the screw means for attaching said universal protective shield to said foot covering via said bores.

* * * * *